US011313516B2

(12) United States Patent
Kurdziel et al.

(10) Patent No.: US 11,313,516 B2
(45) Date of Patent: Apr. 26, 2022

(54) CHARGING PORT FOR PRESSURE VESSEL

(71) Applicant: BellowsTech, LLC, Ormond Beach, FL (US)

(72) Inventors: Anthony Kurdziel, Palm Coast, FL (US); Jeffrey Haas, Ormond Beach, FL (US)

( * ) Notice: Subject to any disclaimer, the term of this patent is extended or adjusted under 35 U.S.C. 154(b) by 0 days.

(21) Appl. No.: 16/547,398

(22) Filed: Aug. 21, 2019

(65) Prior Publication Data

US 2020/0063918 A1 Feb. 27, 2020

Related U.S. Application Data

(60) Provisional application No. 62/722,722, filed on Aug. 24, 2018.

(51) Int. Cl.
*F15B 1/027* (2006.01)
*F17C 13/04* (2006.01)

(52) U.S. Cl.
CPC ..... *F17C 13/04* (2013.01); *F17C 2201/0195* (2013.01); *F17C 2205/0335* (2013.01)

(58) Field of Classification Search
CPC ..... F17C 13/04; F17C 2201/0195; F17C 2205/0335; F17C 2205/0383; F17C 2205/0332; F17C 2205/0338; F17C 1/00
USPC ..... 220/361, 581; 206/0.6
See application file for complete search history.

(56) References Cited

U.S. PATENT DOCUMENTS

| | | | | |
|---|---|---|---|---|
| 3,091,258 | A | 5/1963 | Maretta | |
| 4,858,898 | A | 8/1989 | Niikura et al. | |
| 6,105,632 | A | 8/2000 | Buhlmann | |
| 2010/0326063 | A1* | 12/2010 | LeBlanc | F15B 1/24 60/327 |
| 2013/0112691 | A1 | 5/2013 | Lyons et al. | |
| 2015/0034195 | A1 | 2/2015 | Shima et al. | |

OTHER PUBLICATIONS

International Searching Authority (WIPO), International Search Report and Written Opinion of the International Searching Authority in International Patent Application No. PCT/US2019/047559, Feb. 6, 2020.

* cited by examiner

*Primary Examiner* — Don M Anderson
*Assistant Examiner* — Elizabeth J Volz
(74) *Attorney, Agent, or Firm* — Hunton Andrews Kurth LLP

(57) ABSTRACT

A pressure vessel disclosed herein comprises a chamber. The pressure vessel also comprises a passageway extending from an exterior wall of the pressure vessel to the chamber. A one-way valve is disposed in the passageway. The one-way valve is normally closed and is in fluid communication with the chamber. A plug is disposed within the passageway and is accessible from outside of the pressure vessel.

20 Claims, 5 Drawing Sheets

CHARGING PORT FOR PRESSURE VESSEL

CROSS-REFERENCE TO RELATED APPLICATION

The present application claims priority to U.S. Provisional Patent Application Ser. No. 62/722,722 filed Aug. 24, 2018, which application has the title "CHARGING PORT FOR PRESSURE VESSEL." U.S. Provisional Patent Application Ser. No. 62/722,722 is herein incorporated in its entirety.

FIELD

The present application relates to a pressure vessel and, more particularly, to a charging port for a pressure vessel.

BACKGROUND

Pressure vessels such as accumulators often include Schrader valves protruding from the pressure vessels. As a result, Schrader valves are often damaged during handling, installation, and/or maintenance of the pressure vessels.

DETAILED DESCRIPTION

Figure 1:
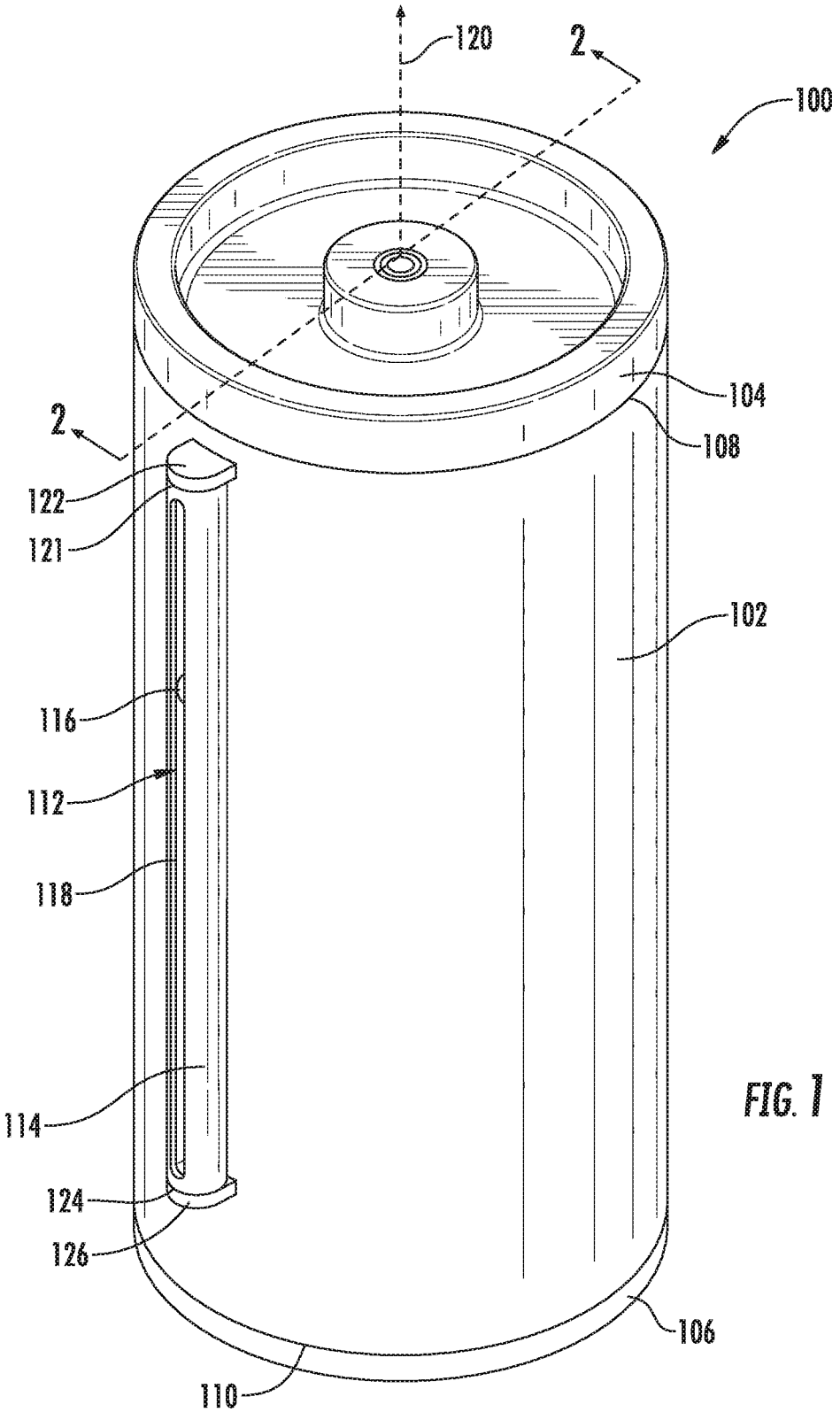
FIG. 1 is a perspective view of an embodiment of the pressure vessel disclosed herein.

FIG. 1 is a perspective view of an embodiment of a pressure vessel 100 disclosed herein. In the illustrated embodiment, the pressure vessel 100 is a gas-charged accumulator. The pressure vessel 100 of FIG. 1 includes a canister 102 including a first end cap 104 and a second end cap 106. The first end cap 104 is coupled to a first end 108 of the canister 102, and the second end cap 106 is coupled to a second end 110 of the canister 102 opposite the first end 108. In the illustrated embodiment, the canister 102 is a cylinder. In other embodiments, the canister 102 and/or the pressure vessel 100 may have other shapes and/or configurations and/or be other types of pressure vessels such as, for example, a water tank, a gas (e.g., propane) tank, a rim and tire assembly, or any other pressure vessel.

In the illustrated embodiment, the pressure vessel 100 includes a visual indicator 112 to indicate a position of a movable component (e.g., a piston assembly) disposed within the canister 102. The visual indicator 112 of FIG. 1 includes a tube 114. A marker 116 is slidably received in the tube 114. In the illustrated embodiment, the marker 116 is a ball including and/or composed of a ferrous material (e.g., steel, iron, etc.) and/or magnet(s). The tube 114 includes a window 118 through which the marker 116 is visible. In the illustrated embodiment, the window 118 is a slot. In other embodiments, the window 118 may be implemented in one or more additional and/or alternative ways (e.g., via a plurality of apertures, a transparent material, etc.). The tube 114 and the window 118 of FIG. 1 extend substantially parallel to a longitudinal axis 120 of the canister 102. In the illustrated embodiment, a first end 121 of the tube 114 is coupled to a first flange 122 extending laterally and/or radially from the canister 102. A second end 124 of the tube 102 is coupled to a second flange 126 extending laterally and/or radially from the canister 102. As described in greater detail below in conjunction with FIG. 2, the marker 116 is magnetically coupled to the movable component disposed within the canister 102 such that a position of the marker 116 indicates a position of the movable component, the volume of a chamber 204 (FIG. inside the canister 102, and/or other measurement(s) and/or state(s) related to the pressure vessel 100. In some embodiments, the tube 114, the window 118, and/or the canister 102 include markings and/or indicia (e.g., graduations) to indicate the position of the marker 116, the volume of the chamber 204 (FIG. 2) inside the canister 102, and/or other measurement(s) and/or state(s) related to the pressure vessel 100 indicated by the marker 116.

Figure 2:
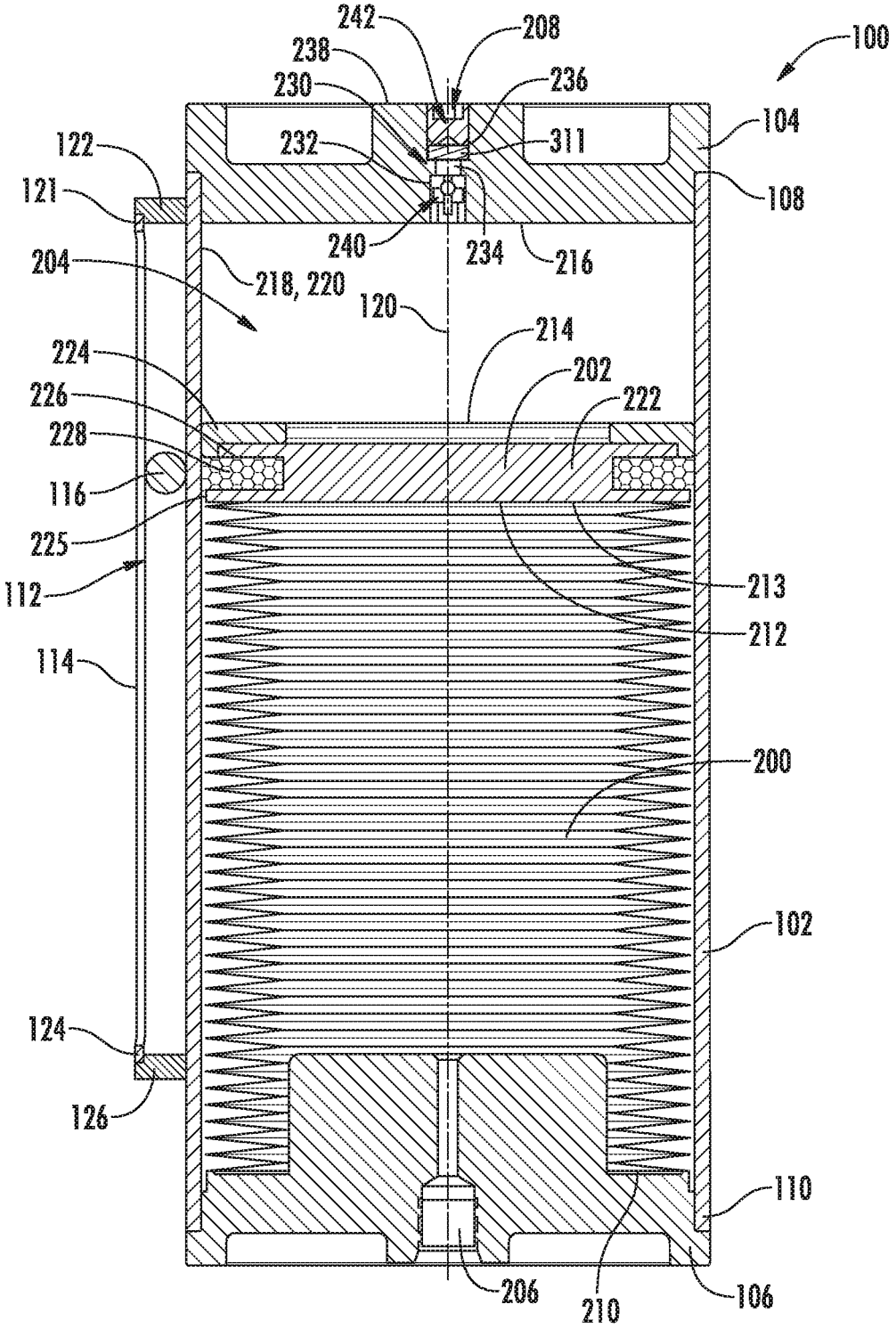
FIG. 2 is a cross-sectional view of the pressure vessel of FIG. 1 along line of FIG. 1.

FIG. 2 is a cross-sectional view of the pressure vessel 100 of FIG. 1 along line 2-2 of FIG. 1. In the illustrated embodiment, the pressure vessel 100 includes a bellows core 200, a piston assembly 202, a chamber 204, a system port 206, and a charging port 208 in accordance with the teachings of this disclosure. In the illustrated embodiment, the second end cap 106 defines the system port 206. The pressure vessel 100 is to be in fluid communication with a fluid system (e.g., a cooling loop) via the system port 206.

During operation of the pressure vessel 100, the bellows core 200 longitudinally expands or contracts (i.e., the bellows core 200 increases or decreases in length in directions substantially parallel to the longitudinal axis 120) and, as a result, changes a volume of the chamber 204. In the illustrated embodiment, the chamber 204 is filled with an inert gas. In other embodiments, the chamber 204 may be filled with one or more additional and/or alternative fluids. In some embodiments, a vacuum exists in the chamber 204. A first end 210 of the bellows core 200 is fixed to the second end cap 106. A second end 212 of the bellows core 200 is coupled to a first side 213 of the piston assembly 202. The second end 212 of the bellows core 200 and the piston assembly 202 are substantially free to move longitudinally within the canister 102 when the bellows core 200 expands or contracts.

The chamber 204 is defined by a second side 214 of the piston assembly 202, a first interior wall 216 of the first end cap 104, and a portion 218 of a second interior wall 220 of the canister 102, In the illustrated embodiment, the piston 202 includes a separator flange 222 and a guide 224. The guide 224 is coupled to the separator flange 222 and defines the second side 214 of the piston assembly. The guide 224 substantially prevents squirming of the bellows core 200 and enables smooth motion of the bellows core 200 when the bellows core 200 expands or contracts.

In the illustrated embodiment, the separator flange 222 is a disk having a circumferential wall 225. The circumferential wall 225 includes a receptacle 226 (e.g., a channel, groove, a bore, and/or any other suitable receptacle), and a magnet 228 is received in the receptacle 226 and coupled to the separator flange 222. The receptacle 226 and, thus, the magnet 228, juxtapose the tube 114 of the visual indicator 112. As a result, the magnet 228 is magnetically coupled to the marker 116 such that magnetic forces between the magnet 228 and the marker 116 cause the marker 116 to be in substantially the same longitudinal position as the magnet 228 and to move longitudinally with the magnet 228. When the bellows core 200 expands or contracts during operation of the pressure vessel 100, the piston assembly 202 and, thus, the magnet 228 move longitudinally with the bellows core 200 and, in response, the marker 116 moves longitudinally within the tube 114 to indicate a longitudinal position of the piston assembly 202, the volume of the chamber 204, and/or one or more additional and/or alternative measurement(s) and/or state(s) related to the pressure vessel 100.

In the illustrated embodiment, the first end cap 104 includes the charging port 208. In other embodiments, the charging port 208 may be disposed in other locations and/or included in additional and/or alternative components (e.g., the canister 102). The charging port 208 of FIG. 2 includes a passageway 230 according to an embodiment, which passageway 230 has a first section 232, a second section 234, and a third section 236. The passageway 230 of FIG. 2 extends through the first end cap 104. In the illustrated embodiment, the second section 234 is interposed between the first section 232 and the third section 236. The first section 232 extends from the interior wall 216 of the first end cap 104 to the second section 234 and is in fluid communication with chamber 204. The third section 236 extends from an exterior wall 238 of the first end cap 104 to the second section 234.

In the illustrated embodiment, the charging port 208 includes a one-way valve 240 disposed in the first section 232. The charging port 208 also includes a plug 242 disposed in the third section 236. In the illustrated embodiment, the first section 232 comprises a bore having a first diameter, the second section 234 comprises a bore having a second diameter smaller than the first diameter, and the third section 236 comprises a bore having a third diameter than the first diameter. In other embodiments, the passageway 230 has other numbers of sections and/or configurations. In other embodiments, the charging port 208 has other numbers of sections and/or configurations.

Figure 3:
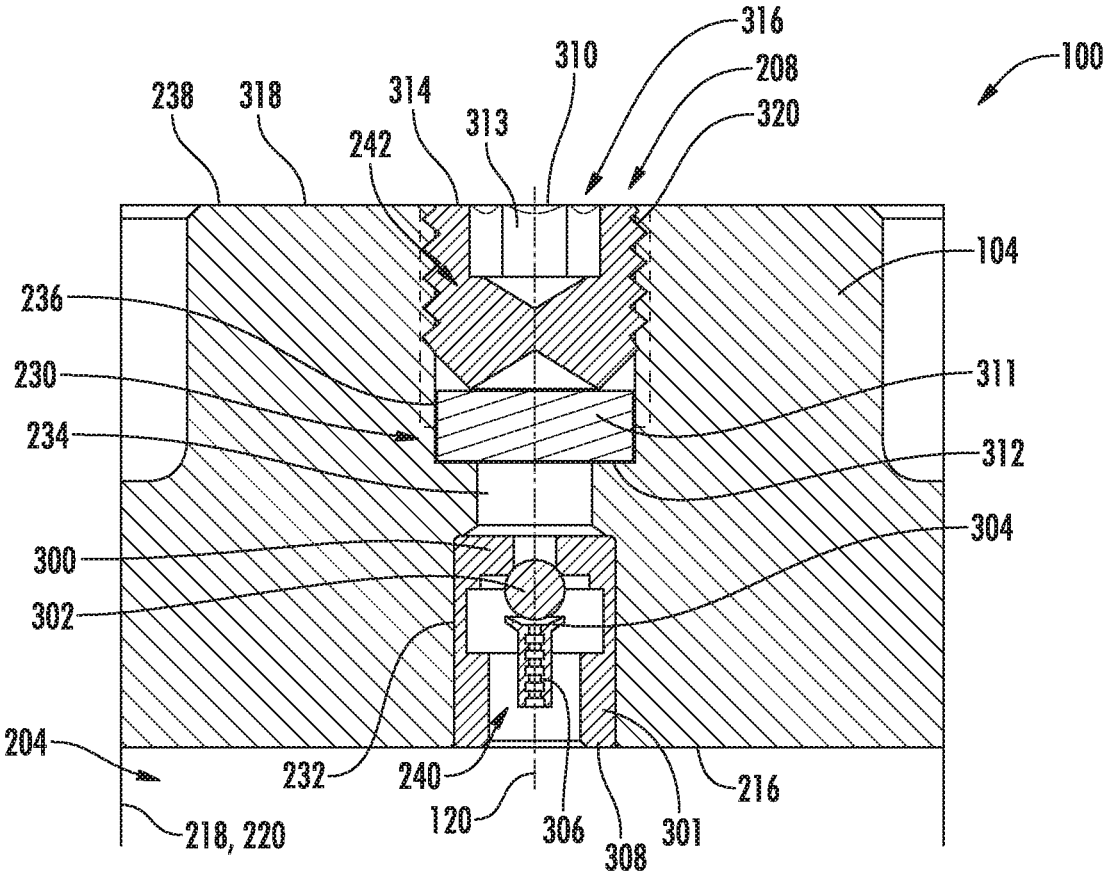
FIG. 3 is an enlarged, cross-sectional view of an embodiment of a charging port of the pressure vessel of FIG. 1.

FIG. 3 is an enlarged, cross-sectional view of the charging port 208 of FIG. 2 along line 2-2 of FIG. 1. In the illustrated embodiment, the one-way valve 240 is a check valve. In other embodiments, the one-way valve 240 may be implemented via other types of valves (e.g., a non-return valve). The one-way valve 240 of FIG. 3 includes a seat 300, a housing 301, a ball 302, a plunger 304, and a spring 306 operatively coupled to the plunger 304. In the illustrated embodiment, the housing 301 of the one-way valve 240 is threaded into the first section 232 of the passageway 230 to secure the one-way valve 240 within the first section 232 and couple the one-way valve 240 to the first end cap 104. In other embodiments, the one-way valve 240 may be secured within the first section 232 and/or coupled to the first end cap 104 and/or other portion(s) of the pressure vessel 100 via one or more additional and/or alternative structures, components, and/or techniques such as, for example, press fitting. In the illustrated embodiment, an end 308 of the housing 301 is flush or substantially flush with the first interior wall 216 of the first end cap 104. In some embodiments, the end 308 of the housing 301 is recessed relative to the first interior wall 216 of the first end cap 104. Thus, when the housing 301 is flush or substantially flush with the first interior wall 216, or recessed relative to the first interior wall 216, the entire one-way valve 240 is disposed within the first section 232 of the passageway 230. In other embodiments, the end 308 of the housing 301 may extend out of the first section 232 of the passageway 230 and into the chamber 204.

The one-way valve 240 of FIG. 3 is normally closed and is configured to automatically prevent fluid from flowing out of the chamber 204. In the illustrated embodiment, the ball 302 is disposed between the seat 300 and the plunger 304. The spring 306 urges or biases the plunger 304 toward the seat 300 and, as a result, the plunger 304 presses the ball 302 toward and/or against the seat 300. When the plunger 304 presses the ball 302 against the seat 300, the ball 302 is in a seated or closed position and forms a fluid seal against the seat 300. As a result, the ball 302 in the closed position prevents fluid from passing through the one-way valve 240.

In the illustrated embodiment, the one-way valve 240 is in fluid communication with the chamber 204, and the one-way valve 240 is oriented such that the spring 306 urges or biases the plunger 304 away from the chamber 204. Thus, pressure within the chamber 204 cooperates with a force of the spring 306 to urge or bias the ball 302 toward the seat 300 and into the closed position. As described in greater detail below, when the ball 302 moves off of the seat 300 and into an open position, and the plug 242 is removed, fluid from the chamber 204 may pass through the one-way valve 240 and out of the pressure vessel 100 via the charging port 208 and/or fluid may be introduced or supplied into the chamber 204 from an external fluid source via the charging port 208.

In the illustrated embodiment, the plug 242 is disposed in the third section 236 of the passageway 230 and is removably coupled to the first end cap 104. In the illustrated embodiment, the plug 242 is a set screw. In other embodiments, the plug 242 may comprise other structures and/or be implemented in other ways. The plug 242 of FIG. 3 is threaded into the third section 236 of the passageway 230 to secure the plug 242 within the third section 236 and removably couple the plug 242 to the first end cap 104. In some embodiments, a sealant (e.g., Teflon tape) is applied to ads 310 of the plug 242 to form a fluid seal between the threads 310 and the first end cap 104 within the third section 236 of the passageway 230. In other embodiments, the charging port 208 and/or the plug 242 may employ a gasket, an O-ring, an plug, a crush gasket, a liquid filler, wax, a disk, and/or one or more additional and/or alternative structures, components, and/or techniques to generate a fluid seal when the plug 242 is secured to the first end cap 104.

For example, in the illustrated embodiment, the charging port 208 includes a rubber disk 311. The rubber disk 311 of FIG. 3 is disposed in the third section 236 of the passageway 230 between the plug 242 and the one-way valve 240. The plug 242 compresses and/or crushes the rubber disk 311 against a seat 312 in the third section 236 of the passageway 230. As a result, the rubber disk 311 forms a fluid seal that prevents fluid from flowing from the second section 234 of the passageway 230 into the third section 236 of the passageway 230.

In the illustrated embodiment, the plug 242 includes a socket 313 accessible from outside of the pressure vessel 100. An end 314 of the plug 242 defines an opening 316 in the socket 313. In the illustrated embodiment, the end 314 faces away from the one-way valve 240 when the plug 242 is received in the passageway 230 of the first end cap 104. The socket 313 of FIG. 3 is shaped and dimensioned to receive a tool such as, for example, an Allen wrench, to enable a user to employ the tool to thread the plug 242 into the third section 236 of the passageway 230 to secure the plug 242 to the first end cap 104 or to unthread the plug 242 from the third section 236 of the passageway 230 to remove the plug 242 from the first end cap 104. In other embodiments, the plug 242 may be removably coupled to the first end cap 104 and/or other portion(s) of the pressure vessel 100 via one or more additional and/or alternative structures, components, and/or techniques. In some embodiments, the plug 242 is permanently coupled to the first end cap 104 (e.g., via a weld) to permanently seal the passageway 230.

In the illustrated embodiment, when the plug 242 is secured to the first end cap 104, the end 314 of the plug 242 is flush or substantially flush with a portion 318 of the exterior wall 238 of the first end cap 104 that surrounds an exterior opening 320 of the third section 236 of the passageway 230. In some embodiments, when the plug 242 is secured to the first end cap 104, the end 314 of the plug 242 is recessed relative to the portion 318 of the exterior end wall 238 of the first end cap 104. Thus, in some embodiments, when the plug 242 is secured to the first end cap 104, no portion of the plug 242 extends or protrudes out of the third section 236 of the passageway 230. Thus, in some embodiments, the entire plug 242 is disposed within the third section 236 of the passageway 230.

The plug 242 is a failsafe or secondary seal. For example, if the spring 306 of the one-way valve 240 fails such that the ball 302 sticks in the open position, the plug 242 blocks or obstructs the passageway 230 to prevent fluid in the chamber 204 from escaping from the pressure vessel 100 via the passageway 230 and/or prevents fluid exterior of the pressure vessel 100 from entering the chamber 204 via the passageway 230. As described in greater detail below, in some embodiments, the plug 242 is removably coupled to first end cap 104 to enable the plug 242 to be removed to selectively supply the chamber 204 with fluid and/or to selectively discharge fluid from the chamber 204.

Figure 4:
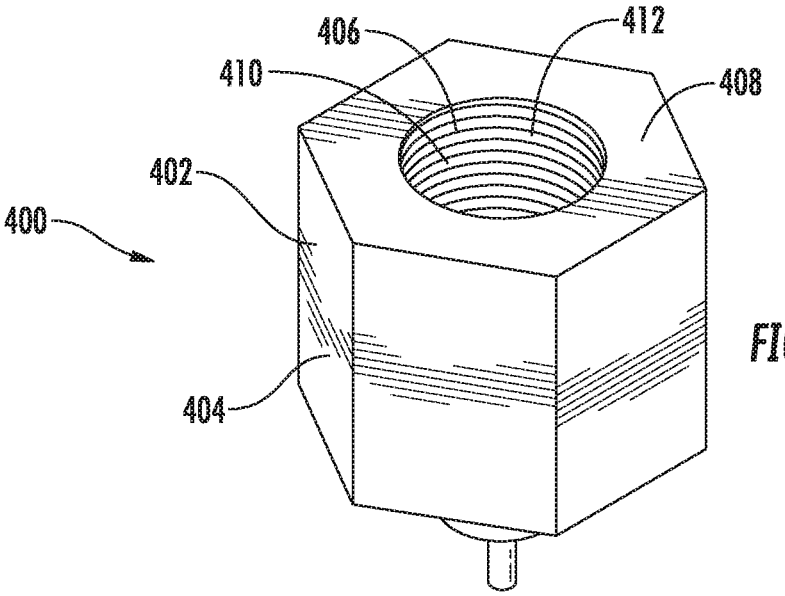
FIG. 4 is a top perspective view of an embodiment of an adapter disclosed herein.
Figure 5:
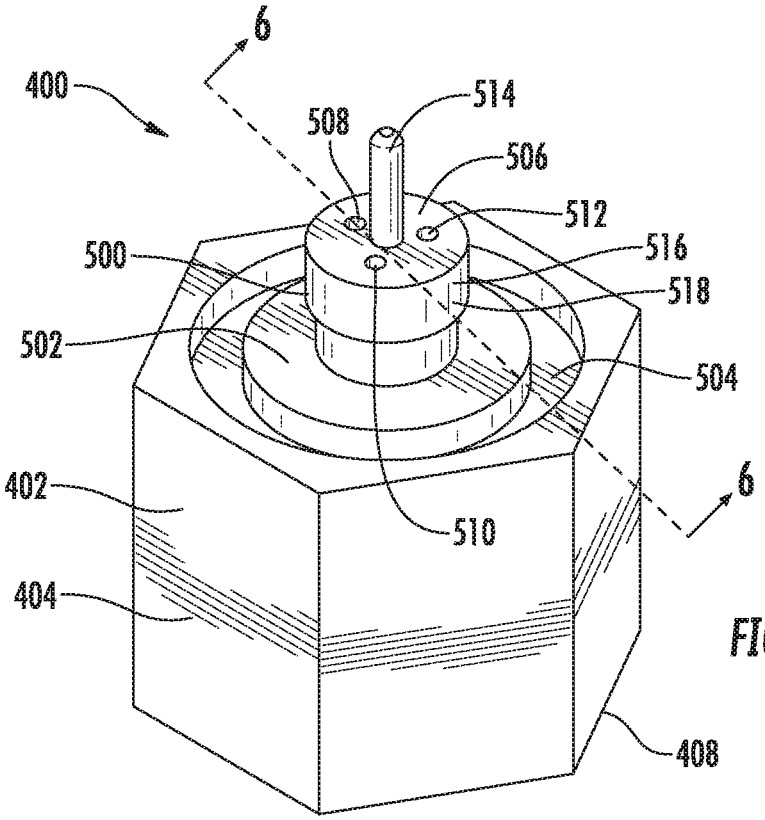
FIG. 5 is a bottom perspective view of the adapter of FIG. 4.
Figure 6:
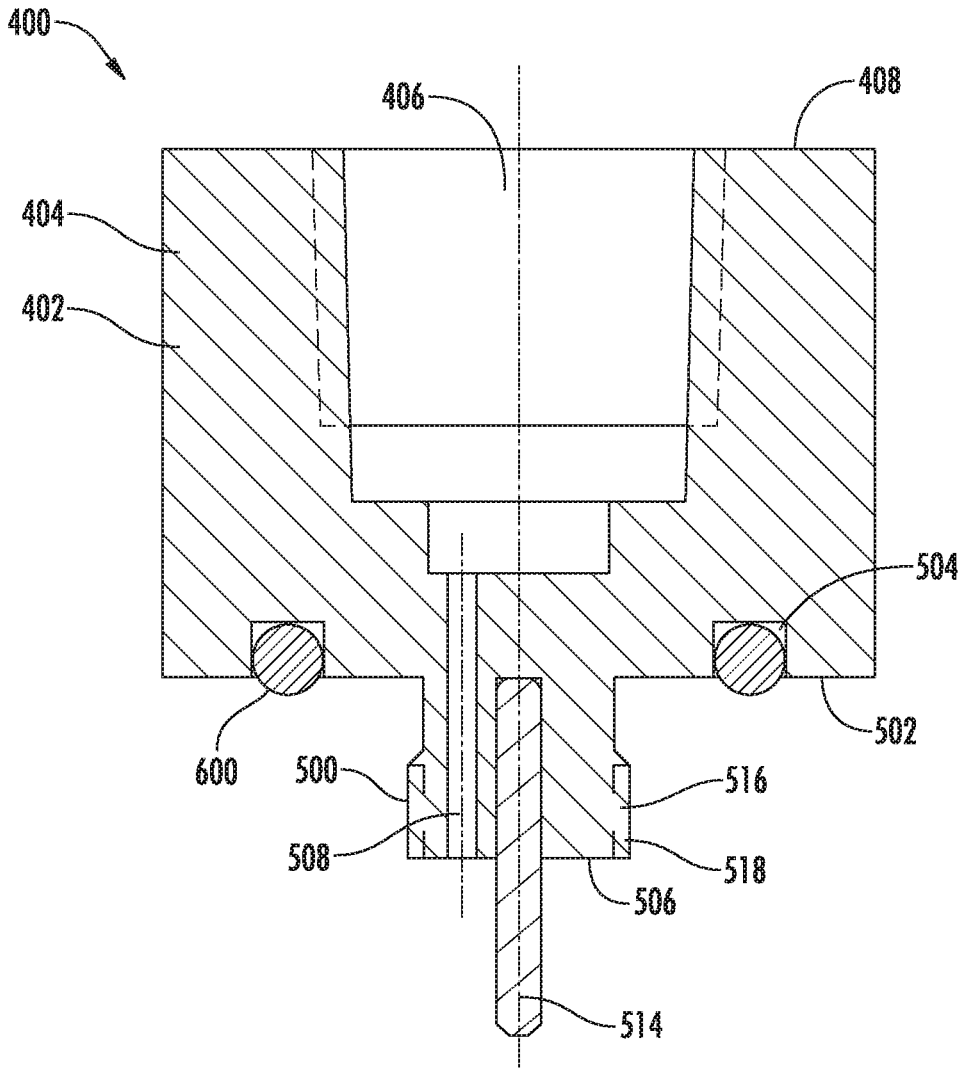
FIG. 6 is a cross-sectional view of the adapter of FIGS. 4-5 along line 6-6 of FIG. 5.

FIGS. 4-6 illustrate an adapter 400 disclosed herein, which may be employed to selectively supply the chamber 204 with fluid and/or to selectively discharge fluid from the chamber 204. FIG. 4 is a top perspective view of the adapter 400. The adapter 400 includes a fitting 402 to couple to a fluid line (not shown) such as, for example, a hose. In the illustrated embodiment, the fitting 402 includes a hexagonal nut 404 including a bore 406 accessible via a first end 408 of the fitting 402. In the illustrated embodiment, a portion 410 of the bore 406 includes threads 412 to enable the fitting 402 to couple to a fluid line via, for example, a male fitting. In other embodiments, the adapter 400 may employ one or more additional and/or alternative fittings.

FIG. 5 is a bottom perspective view of the adapter 400. The adapter 400 includes a neck 500 extending from a second end 502 of the fitting 402 opposite the first end 408. In the illustrated embodiment, the second end 502 of the fitting 402 includes an annular recess 504 disposed about the neck 500, In some embodiments, the annular recess 504 receives a seal 600 (FIG. 6) such as, for example, an o-ring to form a fluid seal between the second end 502 of the adapter 400 and the exterior wall 238 of the first end cap 104 when the adapter 400 is coupled to the first end cap 104. In the illustrated embodiment, the neck 500 includes an end wall 506, and the neck 500 defines a first fluid passageway 508, a second fluid passageway 510, and a third fluid passageway 512. A protrusion 514 extends from the end wall 506 of the neck 500. In the illustrated embodiment, the protrusion 514 is a pin. In other embodiments, the protrusion 514 may be implemented in one or more additional and/or alternative ways. In some embodiments, a portion 516 of the neck 500 includes threads 518 shaped and dimensioned to thread into the third section 236 of the passageway 230 of the first end cap 104 when the plug 242 is removed from the first end cap 104.

FIG. 6 is a cross-sectional view of the adapter 400 of FIGS. 4-5 along line 6-6 of FIG. 5, The first fluid passageway 508, the second fluid passageway 510, and the third fluid passageway 512 extend from the bore 406 and through the neck 500 and the end wall 506 of the neck 500. When the plug 242 is removed from the passageway 230 of the first end cap 104, the neck 500 of the adapter 400 may be received in the passageway 230 to fluidly couple the chamber 20'4 of the pressure vessel 100 to the bore 406 of the fitting 402 and, thus fluidly couple the chamber 204 to a fluid line (not shown) coupled to the fitting 402.

For example, when the neck 500 of the adapter 400 is inserted into the passageway 230, the protrusion 514 extends into the passageway 230 toward the one-way valve 240. As the neck 500 of the adapter 400 is threaded into the third section 236 of the passageway 230; the second end 502 of the fitting 402 and/or the seal 600 disposed in the recess 504 contacts the exterior wall 238 of the first end cap 104 to form a fluid seal between the adapter 400 and the first end cap 104, and the protrusion 514 contacts the ball 302 of the one-way valve 240 and moves the ball 302 toward the chamber 204 from the closed position to the open position to fluidly couple the fluid line (not shown) coupled to the adapter 400 to the chamber 204. To discharge fluid from the chamber 204, fluid from the chamber 204 may flow through the one-way valve 240; through the first fluid passageway 508, the second fluid passageway 510, and the third fluid passageway 512; into the bore 406; and out of the adapter 400 via the fluid line knot shown) coupled to the adapter 400. To supply the chamber 204 with fluid from the fluid line, fluid may flow from the fluid line; through the bore 406 of the fitting 402; through the first fluid passageway 508, the second fluid passageway 510, and the third fluid passageway 512; through the one-way valve 240; and into the chamber 204, When the adapter 400 is removed from the first end cap 104, the ball 302 returns to the closed position to prevent fluid from escaping from the chamber 204 via the first end cap 104.

Although certain embodiments have been described in this disclosure, the scope of coverage of this patent is not limited to the embodiments described herein. This patent covers all methods, apparatus, and articles of manufacture falling within the scope of the claims literally or under the doctrine of equivalents.

What is claimed is:

1. A pressure vessel, comprising:

a chamber;

a rubber disk;

a passageway extending from an exterior wall of the pressure vessel to the chamber;

a one-way valve disposed in the passageway, the one-way valve being normally closed and in fluid communication with the chamber; and a plug disposed within the passageway, the plug coupled to the pressure vessel and accessible from outside of the pressure vessel, wherein the passageway includes a first section, a second section, and a third section, the passageway extends through a first end cap, the second section is interposed directly between the first section and the third section, the first section extends from an interior wall of the first end cap to the second section and is in fluid communication with the chamber, the third section extends from an exterior wall of the first end cap to the second section, wherein the second section is narrower in width than both the first and third sections, and wherein the rubber disk is disposed in the third section between the plug and the one-way valve so that the plug compresses the rubber disk against a seat in the third section to form a fluid seal that prevents the fluid from flowing from the second section into the third section.

2. The pressure vessel of claim 1, wherein an end of the plug is substantially flush with the exterior wall of the pressure vessel.

3. The pressure vessel of claim 1, wherein an end of the plug is recessed in the passageway relative to the exterior wall, and further wherein the end faces away from the one-way valve when the plug is disposed within the passageway.

4. The pressure vessel of claim 1, wherein the one-way valve comprises a check valve.

5. The pressure vessel of claim 4, wherein the plug comprises a set screw.

6. The pressure vessel of claim 5, wherein the plug comprises a socket to receive a tool.

7. An apparatus, comprising:

a pressure vessel comprising an interior chamber and a charging port, the charging port comprising:

a passageway extending from an exterior of the pressure vessel to the chamber;

a rubber disk;

a plug disposed in the passageway and coupled to the pressure vessel; and a one-way valve disposed in the passageway between the interior chamber and the plug, wherein the charging port enables fluid to be supplied to the interior chamber when the plug is removed from the passageway and the one-way valve is in an open position, wherein the passageway includes a first section, a second section, and a third section, the passageway extends through a first end cap, the second section is interposed directly between the first section and the third section, the first section extends from an interior wall of the first end cap to the second section and is in fluid communication with the chamber, the third section extends from an exterior wall of the first end cap to the second section, wherein the second section is narrower in width than both the first and third sections, and wherein the rubber disk is disposed in the third section between the plug and the one-way valve so that the plug compresses the rubber disk against a seat in the third section to form a fluid seal that prevents the fluid from flowing from the second section into the third section.

8. The apparatus of claim 7, wherein the pressure vessel is an accumulator.

9. The apparatus of claim 7, wherein the one-way valve is a check valve.

10. The apparatus of claim 9, wherein the check valve comprises a ball, the ball to move toward the chamber to move from a closed position to the open position.

11. The apparatus of claim 7, wherein the entire one-way valve is disposed within the passageway.

12. The apparatus of claim 11, wherein the entire plug is disposed within the passageway.

13. A system, comprising:

a pressure vessel including a chamber, a passageway extending from an exterior wall of the pressure vessel to the chamber, and a one-way valve disposed in the passageway, the one-way valve being normally closed and in fluid communication with the chamber;

a rubber disk;

a plug to be disposed within the passageway and removably coupled to the pressure vessel, and an adapter to be disposed within the passageway when the plug is removed from the passageway, the adapter configured to move the one-way valve from a closed position to an open position, wherein the passageway includes a first section, a second section, and a third section, the passageway extends through a first end cap, the second section is interposed directly between the first section and the third section, the first section extends from an interior wall of the first end cap to the second section and is in fluid communication with the chamber, the third section extends from an exterior wall of the first end cap to the second section, wherein the second section is narrower in width than both the first and third sections, and wherein the rubber disk is disposed in the third section between the plug and the one-way valve so that the plug compresses the rubber disk against a seat in the third section to form a fluid seal that prevents the fluid from flowing from the second section into the third section.

14. The system of claim 13, wherein the adapter includes a fitting configured to couple to a fluid line.

15. The system of claim 14, wherein the adapter includes a pin to contact the one-way valve when the adapter is disposed within the passageway.

16. The system of claim 14, wherein the adapter includes a fluid passageway to fluidly couple the chamber to the fitting when the adapter is disposed within the passageway.

17. The system of claim 13, wherein the adapter is configured to move a portion of the one-way valve toward the chamber in order to move the one-way valve from the closed position to the open position.

18. The system of claim 13, wherein the entire plug is disposed in the passageway when the plug is coupled to the pressure vessel.

19. The pressure vessel of claim 13, wherein the one-way valve comprises a check valve.

20. The pressure vessel of claim 13, wherein the plug comprises a set screw.

* * * * *